US010201211B2

(12) United States Patent
Diepenbrock

(10) Patent No.: US 10,201,211 B2
(45) Date of Patent: Feb. 12, 2019

(54) INSOLE WITH INFERIORLY EXTENDING PROJECTIONS

(71) Applicant: NIKE, Inc., Beaverton, OR (US)

(72) Inventor: James E. Diepenbrock, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 87 days.

(21) Appl. No.: 14/847,897

(22) Filed: Sep. 8, 2015

(65) Prior Publication Data

US 2016/0037861 A1 Feb. 11, 2016

Related U.S. Application Data

(62) Division of application No. 13/458,263, filed on Apr. 27, 2012, now Pat. No. 9,155,355.

(51) Int. Cl.

| | |
|---|---|
| ***A43B 13/40*** | (2006.01) |
| ***A43B 17/03*** | (2006.01) |
| ***A43B 17/00*** | (2006.01) |
| ***A43B 17/02*** | (2006.01) |
| *A43B 7/06* | (2006.01) |

(52) U.S. Cl.

CPC ..... *A43B 13/40* (2013.01); *A43B 17/003* (2013.01); *A43B 17/023* (2013.01); *A43B 17/03* (2013.01); *A43B 7/06* (2013.01)

(58) Field of Classification Search

CPC ..... A43B 13/40; A43B 17/003; A43B 13/023; A43B 17/03; A43B 7/06

See application file for complete search history.

(56) References Cited

U.S. PATENT DOCUMENTS

| | | | | |
|---|---|---|---|---|
| 989,894 | A * | 4/1911 | Byrne | A43B 17/03 36/153 |
| 2,090,881 | A * | 8/1937 | Wilson | A43B 13/20 36/29 |
| 2,119,807 | A | 6/1938 | Farley | |
| 2,358,342 | A * | 9/1944 | Margolin | A43B 7/143 36/147 |
| 3,043,025 | A * | 7/1962 | Semon | A43B 13/223 36/59 R |
| 3,231,454 | A * | 1/1966 | Williams | B65D 81/03 206/521 |

(Continued)

FOREIGN PATENT DOCUMENTS

| | | |
|---|---|---|
| JP | S5673404 A | 6/1981 |
| JP | 3048055 | 2/1998 |

(Continued)

*Primary Examiner* — Jila M Mohandesi

(74) *Attorney, Agent, or Firm* — Honigman Miller Schwartz and Cohn LLP; Matthew H. Szalach; Jonathan P. O'Brien

(57) ABSTRACT

An insole for an article of footwear includes a base that extends generally in the transverse direction, and the base includes a base superior surface and a base inferior surface. Furthermore, the insole includes a dampener that is resiliently flexible to cushion the foot of the wearer. The dampener extends inferiorly from the inferior surface of the base and terminates at a dampener inferior surface. The dampener also is rounded in a cross section taken in the inferior-superior direction. The dampener also includes an opening that extends through the dampener inferior surface and that extends superiorly therefrom.

20 Claims, 5 Drawing Sheets

(56) References Cited

U.S. PATENT DOCUMENTS 4,118,878 A * 10/1978 Semon ..... A43B 13/203 36/59 C
4,215,492 A 8/1980 Sandmeier
4,485,568 A 12/1984 Landi et al.
4,534,121 A 8/1985 Autry
4,547,978 A 10/1985 Radford
4,605,582 A * 8/1986 Sias ..... A61G 7/05707 428/120
4,619,056 A 10/1986 Lin et al.
4,673,605 A * 6/1987 Sias ..... A61G 7/05707 428/120
D294,212 S * 2/1988 Sias ..... D6/587
4,831,749 A 5/1989 Tsai
4,843,741 A * 7/1989 Yung-Mao ..... A43B 1/0072 36/114
4,845,863 A 7/1989 Yung-Mao
4,977,691 A 12/1990 Orchard
5,035,068 A 7/1991 Biasi
5,233,767 A * 8/1993 Kramer ..... A43B 7/081 36/28
5,473,788 A * 12/1995 Aragona ..... A47K 7/026 15/104.92
5,493,791 A * 2/1996 Kramer ..... A43B 7/081 36/28
5,517,770 A 5/1996 Martin et al.
5,551,173 A * 9/1996 Chambers ..... A43B 7/146 36/141
5,655,314 A 8/1997 Petracci
5,731,958 A * 3/1998 Kozel ..... H01R 12/7058 174/260
5,894,687 A 4/1999 Lin
5,915,819 A 6/1999 Gooding
6,006,447 A 12/1999 Neal et al.
6,076,282 A * 6/2000 Brue' ..... A43B 7/081 36/141
6,199,304 B1 * 3/2001 Ludemann ..... A43B 17/02 36/3 R
6,266,898 B1 7/2001 Cheng
6,434,859 B1 * 8/2002 Kim ..... A43B 7/142 36/43
6,477,789 B2 11/2002 Cheng
D474,588 S 5/2003 Dean
6,715,221 B1 * 4/2004 Sasaki ..... A43B 1/0045 36/141
6,732,457 B2 5/2004 Gardiner
7,024,803 B2 4/2006 Basso
7,246,454 B2 7/2007 Kramer
7,685,743 B2 3/2010 Swigart et al.
7,695,069 B2 * 4/2010 Prust ..... A47C 7/74 297/452.45
7,703,219 B2 * 4/2010 Beck ..... A43B 17/08 36/147
7,712,229 B2 5/2010 Yang
8,191,263 B2 6/2012 Follo et al.
8,367,184 B2 * 2/2013 Slama ..... B29C 43/222 181/284
9,144,264 B2 * 9/2015 Marvin ..... A43B 13/186
9,635,897 B2 * 5/2017 Prust ..... A47C 7/021
2003/0061733 A1 4/2003 Karsten
2010/0024246 A1 2/2010 Park
2010/0170117 A1 * 7/2010 Kim ..... A43B 1/0009 36/3 B

FOREIGN PATENT DOCUMENTS

KR 19940018805 8/1994
KR 200335959 Y1 12/2003

* cited by examiner

INSOLE WITH INFERIORLY EXTENDING PROJECTIONS

CROSS-REFERENCE TO RELATED APPLICATION(S)

This application is a divisional application of application Ser. No. 13/458,263, filed Apr. 27, 2012, published as U.S. Patent Publication No. 2013/0283638 on Oct. 31, 2013, the entire disclosure of which is hereby incorporated by reference.

BACKGROUND OF THE INVENTION

1. Field of the Invention

The present disclosure relates to insoles for articles of footwear. More specifically, the present disclosure relates to insoles having inferiorly extending projections that provide support for the wearer.

2. Background

Many articles of footwear include an insole that provides support and comfort to a wearer's foot. The insole is typically a thin sheet of material that is layered over the midsole and that is disposed directly below the wearer's foot. The insole can have a substantially constant thickness throughout. Also, the insole can be flat, or the insole can be curved (e.g., to conform more closely to the curvature of the wearer's foot).

Insoles can be made out of many different types of material. Some insoles are made of leather or plastic and do not substantially provide cushioning. Other insoles are made of resilient materials such as foam, gel, and rubber, to provide a cushioning layer to provide additional comfort and to dampen (i.e., attenuate) impact loads and other loads. Additionally, some insoles can include raised areas or other features that increase the insole's ability to dampen impact or other loads. However, most of the known insoles that provide ample cushioning and dampening do not adequately provide other beneficial characteristics such as moisture control, breathability, etc.

Accordingly, despite the benefits of known insoles for articles of footwear, there remains a need for impact-attenuating insoles that do not compromise breathability, comfort, and moisture control.

SUMMARY

The present disclosure overcomes these and other shortfalls with the disclosed insoles for articles of footwear.

An insole for an article of footwear is disclosed that defines a transverse direction and an inferior-superior direction. The article of footwear is operable to be worn on a foot of a wearer. The insole includes a base that extends generally in the transverse direction, and the base includes a base superior surface and a base inferior surface. Furthermore, the insole includes a dampener that is resiliently flexible to cushion the foot of the wearer. The dampener extends inferiorly from the inferior surface of the base and terminates at a dampener inferior surface. The dampener also is rounded in a cross section taken in the inferior-superior direction. The dampener also includes an opening that extends through the dampener inferior surface and that extends superiorly therefrom.

Additionally, an insole for an article of footwear operable to be worn on a foot of a wearer is disclosed. The article of footwear defines a transverse direction and an inferior-superior direction. The insole includes a base that extends generally in the transverse direction. The base includes a base superior surface and a base inferior surface. Moreover, the insole includes a dampener that is resiliently flexible to cushion the foot of the wearer. The dampener extends inferiorly from the inferior surface of the base and terminating at a dampener inferior surface, the dampener also includes an opening that extends through the dampener inferior surface and that extends superiorly therefrom. The dampener further includes at least one channel that is in communication with the opening and that radiates therefrom.

Furthermore, an article of footwear is disclosed that defines a transverse direction and an inferior-superior direction. The article of footwear is operable to be worn on a foot of a wearer. The footwear includes an upper and a sole assembly that includes an outsole, a midsole, and an insole. The insole includes a base that extends generally in the transverse direction. The base includes a base superior surface and a base inferior surface. The base superior surface includes a plurality of bumps. The insole also includes a plurality of dampeners that are resiliently flexible to cushion the foot of the wearer. The plurality of dampeners are integrally connected to the base so as to be monolithic, and the plurality of dampeners each extend inferiorly from the inferior surface of the base and terminate at a respective dampener inferior surface. The plurality of dampeners also are rounded in a respective planar cross section taken in the inferior-superior direction. The plurality of dampeners each also include an opening that extends through the respective dampener inferior surface and that extends superiorly therefrom. The plurality of dampeners each also include a plurality of channels that are in communication with the respective opening and that radiate therefrom.

This section provides a general summary of the present disclosure and is not a comprehensive explanation of its full scope or all of its features. Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
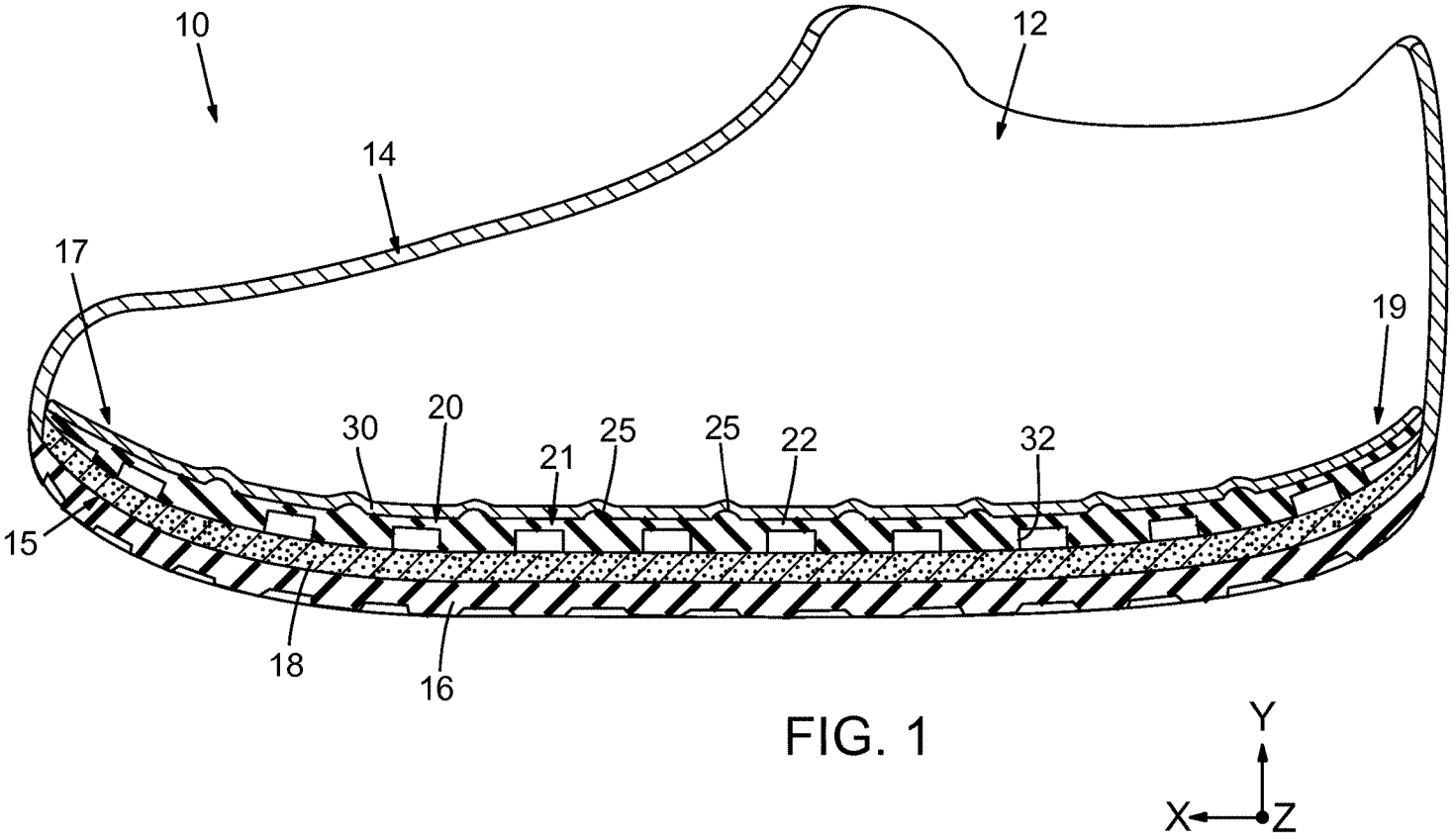
FIG. 1 is a section view of an exemplary embodiment of an article of footwear of the present disclosure.

Referring initially to FIG. 1, an article of footwear 10 is illustrated according to various exemplary embodiments of the present disclosure. In the embodiments illustrated, the footwear 10 is a shoe; however, it will be appreciated that the footwear 10 could be a boot, a sandal, or any other suitable type of footwear without departing from the scope of the present disclosure.

The article of footwear 10 can generally include an upper 14 and a sole assembly 15 that are attached and that cooperate to define an interior space 12 that receives a foot of a wearer (not shown). It will be appreciated that the footwear 10 can define a first transverse direction X, a second transverse direction Z, and an inferior-superior direction Y. The first transverse direction X can extend horizontally and span between a forefoot region 17 and a heel region 19 (i.e., in the posterior-anterior direction). The second transverse direction Z can also extend horizontally and span in the medial-lateral direction, perpendicular to the direction X indicated in FIG. 1. The inferior-superior direction Y shown in FIG. 1 is perpendicular to the transverse direction X and is generally vertical.

The forefoot region 17 receives and supports the forefoot (e.g., the toes, metatarsals, etc.) of the wearer's foot, and the heel region 19 receives and supports the heel of the wearer's foot. It is understood that the footwear 10 includes a medial and lateral region as well, but these regions are not shown in the section view of FIG. 1. It is also understood that none of these regions is intended to demarcate exact boundaries within the article of footwear 10. Rather, the description of these regions is a general guideline used for illustrative purposes only.

The upper 14 can include one or more sheets of flexible material that cover the wearer's foot. The sole assembly 15 can be attached to the upper 14 and can extend underneath the wearer's foot. The sole assembly 15 can generally include an outsole 16, a midsole 18, and an insole 20.

The outsole 16 can be made from a relatively high friction material (e.g., rubber, etc.) and can include treads, cleats, or other features that increase traction for the footwear 10. The outsole 16 can define the lowermost portion of the footwear 10.

Also, the midsole 18 can be made out of a resiliently flexible and resiliently compressible material (foam, etc.). The midsole 18 can be disposed between the outsole 16 and the insole 20 to provide cushioning for the wearer's foot. The midsole 18 can additionally include fluid-filled bladders (not shown) or other members for cushioning the wearer's foot.

The insole 20 can be layered over the midsole 18 such that the insole 20 is disposed directly underneath the wearer's foot. The insole 20 can extend transversely (i.e., in both the transverse directions X, Z) across substantially the entire sole assembly 15, or the insole 20 can extend only over a portion of the sole assembly 15. For instance, the insole 20 can extend only over the heel region 19 or only over the forefoot region 17 to provide focused support for those corresponding areas of the wearer's foot.

As shown in FIG. 1, the insole 20 can include a main body 21 and a cover 30. The main body 21 can be a single piece of monolithic material (e.g., a molded piece of material). The main body 21 can be made out of resiliently compressible material (e.g., foam, etc.). Also, the cover 30 can be a sheet of moisture-absorbing fabric or other material that is layered over and fixed to the main body 21 (e.g., by adhesives, etc.). The insole 20 can be removably layered over the midsole 18, or the insole 20 can be fixedly attached to the midsole 18 (e.g., via adhesives, fasteners, etc.).

Figure 2:
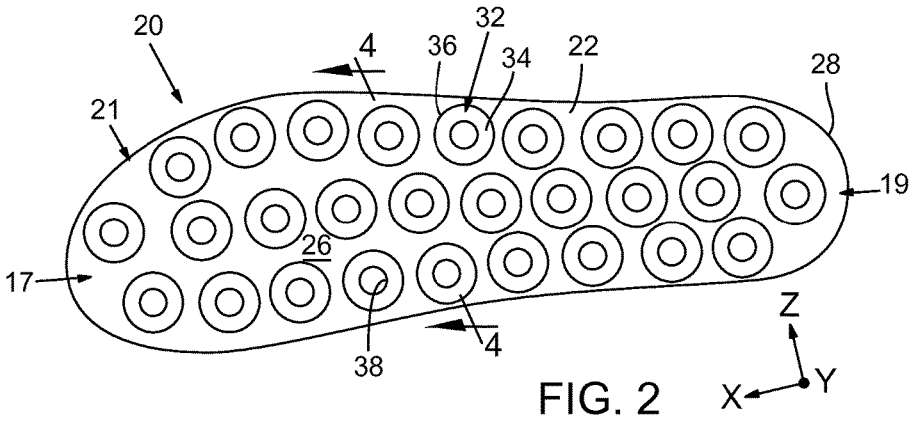
FIG. 2 is a bottom plan view of an insole of the article of footwear of FIG. 1.
Figure 3:
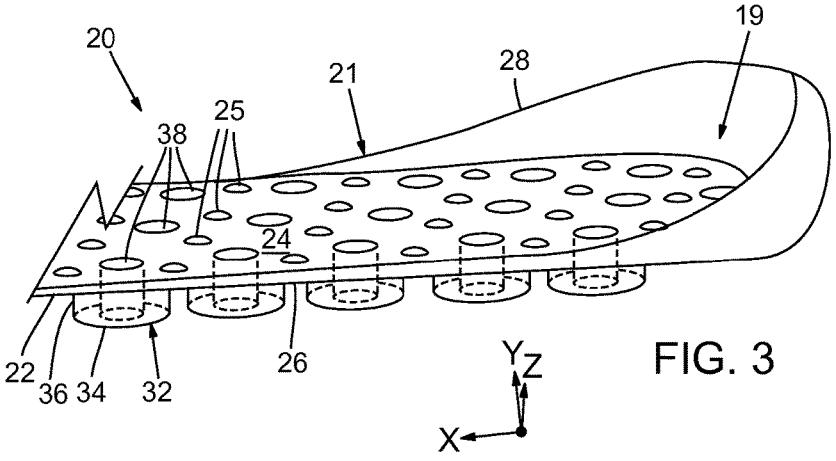
FIG. 3 is an isometric view of a posterior portion of the insole of FIG. 2.
Figure 4:
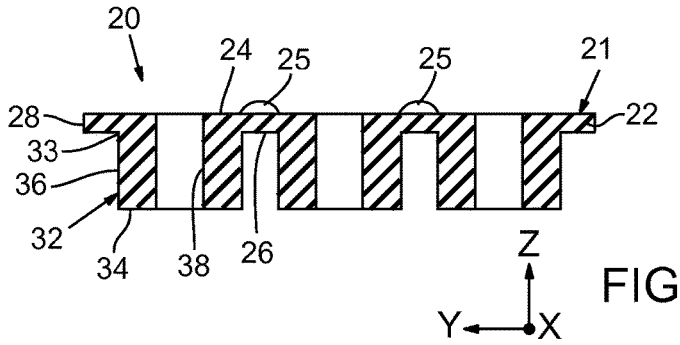
FIG. 4 is a section view taken along the line 4-4 of FIG. 2.

Referring now to FIGS. 2-4, exemplary embodiments of the main body 21 of the insole 20 are shown in detail. The main body 21 can include a base 22. The base 22 can be relatively thin and sheet-like and can be made out of a resiliently flexible (i.e., resiliently compressible) material. The base 22 can extend in the transverse directions X, Z between the medial, lateral, anterior, and posterior ends of the insole 20. The thickness of the base 22 can be substantially constant throughout, or the thickness can vary across the transverse directions (e.g., to contour and conform to the anatomical curvature of the wearer's foot).

As shown in FIG. 3, the base 22 can include a superior surface 24 (i.e., base superior surface) and an inferior surface 26 (i.e., base inferior surface). In some embodiments, the superior surface 24 can include a plurality of bumps 25 or raised areas that are curved and rounded three-dimensionally. The bumps 25 can have any suitable shape and can be arranged in any suitable pattern across the superior surface 24. In other embodiments, the superior surface 24 can be substantially flat without the bumps 25. It will be appreciated that the bumps 25 can apply pressure to the wearer's foot and "massage" the wearer's foot during walking, running, etc. to improve comfort.

Also, the base 22 can include a peripheral edge 28. As shown in FIG. 3, the peripheral edge 28 can be curved and contoured superiorly upwards from adjacent (i.e., interior) areas of the base 22. For instance, in the embodiments illustrated in FIG. 3, the peripheral edge 28 at the heel region 19 can curve superiorly upwards to substantially cup the heel of the wearer's foot for added comfort. Other regions of the peripheral edge 28 can also curve superiorly (e.g., adjacent the arch of the foot of the wearer).

Furthermore, the main body 21 of the insole 20 can include one or more dampeners 32 that extend inferiorly from the inferior surface 26 of the base 22. The dampeners 32 can be resiliently flexible (i.e., resiliently compressible) to thereby cushion the foot of the wearer.

In the embodiments illustrated in FIG. 2, the insole 20 includes a plurality of dampeners 32. The dampeners 32 can be arranged and aligned generally in rows and columns such that the dampeners 32 are spaced transversely across substantially the entire insole 20. The dampeners 32 can be cylindrical and hollow with a respective annular transverse cross section. It will be appreciated, however, that the dampeners 32 can have any suitable size and shape. Moreover, all of the dampeners 32 can be sized and shaped substantially similarly, or the dampeners 32 of the insole 20 can vary in size and shape.

More specifically, as shown in FIG. 4, the dampeners 32 can each include a superior end 33 that is attached to the inferior surface 26 of the base 22. The superior end 33 can be integrally connected to the base 22 so as to be monolithic. In other embodiments, the dampeners 32 are removably connected to the inferior surface 26 of the base 22, and the dampeners 32 can be interchanged and replaced by other dampeners 32 (e.g., to vary the resilience, colors, materials, or other characteristics of the dampeners 32 in the insole 20).

Each dampener 32 can extend inferiorly from the base 22 and can terminate at a respective inferior surface 34. As shown in FIG. 4, the inferior surface 34 can be flat and substantially parallel to the base 22. However, the inferior surface 34 can be wavy or can include another type of texturing. Also, the inferior surface 34 can be annular in shape. As shown in FIG. 1, the inferior surfaces 34 of the dampeners 32 can be supported directly on (i.e., abut) the midsole 18 of the footwear 10.

Also, each of the dampeners 32 can include a sidewall 36 that extends superiorly from the inferior surface 34 to the superior end 33. The sidewall 36 can be curved (e.g., circular, elliptical, etc.) in the X-Z plane (i.e., the transverse plane), and the sidewall 36 can extend substantially perpendicular to the inferior surface 34 in the inferior-superior direction Y. In other embodiments that will be discussed, the sidewall 36 can curve convexly and/or concavely in a planar cross section taken substantially perpendicular to the inferior-superior direction Y.

Furthermore, the dampeners 32 can each include an opening 38. In the embodiments shown in FIGS. 3 and 4, the opening 38 is a through hole that extends through both the inferior surface 34 of the dampener 32 and the superior surface 24 of the base 22. The covering 30 of the insole 20 (FIG. 1) can also include corresponding openings that communicate with the openings 38 in the main body 21, or the covering 30 can cover over the openings 38. One or more of the openings 38 can extend linearly and parallel to the inferior-superior direction Y. Also, in some embodiments, the opening 38 can curve along its axis and/or can be disposed at an acute angle relative to the inferior-superior direction Y. The opening 38 can have a circular cross section of any suitable diameter; however, it will be appreciated that the opening 38 can have any suitable shape and size. Also, it will be appreciated that the size and/or shape of the openings 38 can vary among the different dampeners 32. Furthermore, in the embodiments illustrated, the width (i.e., diameter) of the openings 38 can remain substantially constant between the inferior surface 34 and the superior surface 24; however, one or more of the openings 38 can have a tapering width.

Thus, during walking, running or other movements or when the wearer's weight is applied to the insole 20, the insole can resiliently compress in the inferior-superior direction Y to provide the wearer with cushioned support. More specifically, the base 22 can resiliently compress, and the dampeners 32 can also resiliently compress. The dampeners 32 can resiliently expand radially outward in the transverse direction X as well. Then, when the load is removed, the dampeners 32 and base can resiliently recover to the neutral state shown in FIGS. 1-4. Also, this resilient flexing can absorb (i.e., dampen, attenuate, etc.) at least a portion of impact loads (e.g., during running) for added comfort for the wearer.

Moreover, because air can flow through the openings 38, and the openings 38 are in communication with each other, ventilation in the article of footwear 10 can be improved. Thus, perspiration can more readily evaporate, the footwear 10 is less likely to retain disagreeable smells, and the footwear 10 can be more comfortable to wear for longer periods of time. Furthermore, the openings 38 can advantageously reduce the weight of the insole 20.

The insole 20 can include other features as well. For example, moisture control and/or moisture wicking materials may be included in any portion of the insole 20. Odor control materials, anti-fungal materials, etc. may also be included in any portion of the insole 20. The insole 20 can also be removable and washable. The insole 20 may be sold separately from the remainder of the article of footwear 10 or may be sold as a single unit with the article of footwear 10.

Figure 5:
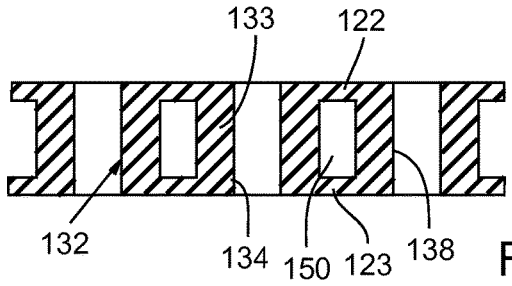
FIG. 5 is a section view of additional embodiments of the insole.

Referring now to FIG. 5, additional embodiments of the insole 120 are illustrated. Components that correspond to those of the embodiments of FIGS. 1-4 are indicated with corresponding reference numerals increased by 100.

As shown, the insole 120 can include a first base 122 and a second base 123. The first base 122 and the second base 123 can be substantially similar (i.e., sheets of resiliently flexible material that extends transversely), except the first base 122 can be attached to the superior end 133 of the dampeners 132 while the second base 123 can be attached to the inferior surface 134 of the dampeners 132.

One or more of the openings 138 can be a through hole that extends through the first base 122, the respective dampener 132, and the second base 123. Also, a space 150 can be cooperatively defined between the dampeners 132, the first base 122, and the second base 123.

Figure 6:
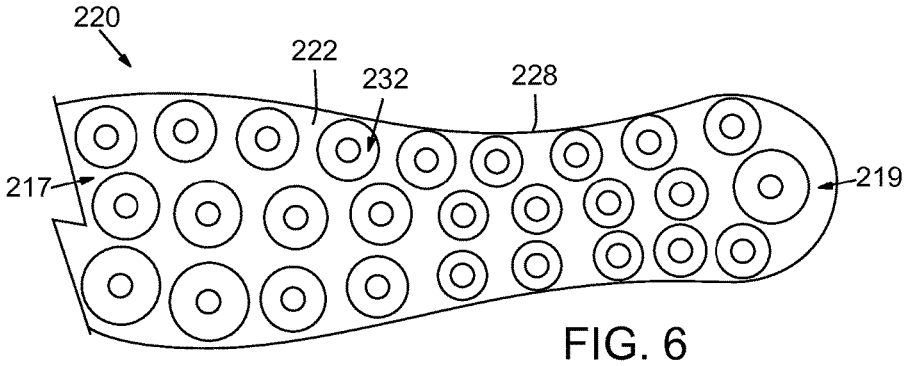
FIG. 6 is a bottom view of additional embodiments of the insole.
Figure 7:
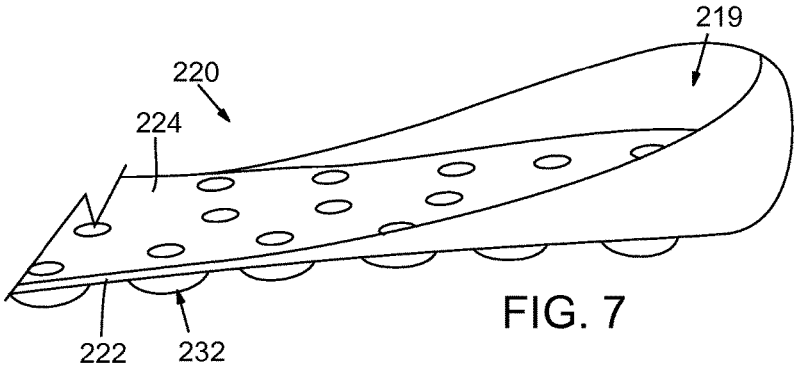
FIG. 7 is an isometric view of the insole of FIG. 6.
Figure 8:
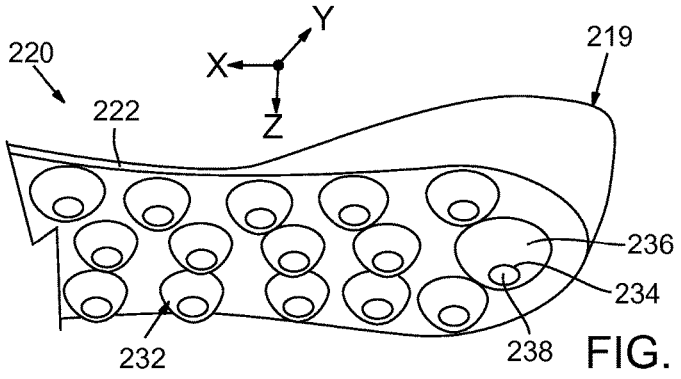
FIG. 8 is a bottom, isometric view of the insole of FIG. 6.

Referring now to FIGS. 6, 7, and 8, additional embodiments of the insole 220 are illustrated. Components that are similar to those of the embodiments of FIGS. 1-4 are indicated by corresponding reference numerals increased by 200.

As shown in FIG. 6, the dampeners 232 of the insole 220 have a variety of widths (i.e., diameters). In the embodiments shown, the dampeners 232 closer to the edge 228 are larger in width than the dampeners 232 further away from the edge 228. Also, in the embodiments shown, dampeners 232 in the heel region 219 and the forefoot region 217 are generally larger in width than the other dampeners 232. It will be appreciated that the dimensions of the dampeners 232 can vary in other ways as well.

Also, as shown in FIG. 7, the superior surface 224 of the base 222 does not include the bumps 25 described above in relation to the embodiments of FIGS. 1 and 3. Stated differently, the superior surface 224 is substantially flat, except that the superior surface contours superiorly for cupping the wearer's heel in the heel region 219.

Moreover, as shown in FIGS. 7 and 8, the dampeners 232 are convexly and three-dimensionally rounded. In the illustrated embodiments, the inferior surface 234 is a rim extending annularly about the respective opening 238, and the sidewall 236 curves superiorly from the inferior surface 234. Moreover, in the embodiments illustrated, the sidewall 236 curves in the X-Y plane, in the Y-Z plane, and in all other cross sections taken in the inferior-superior direction. Thus, the sidewall 236 can be generally hemispherical in shape. It will be appreciated, however, that the curvature of the sidewall 236 can be different from the embodiments illustrated. For instance, dampeners 232 that are disposed in the heel region 219 can be rounded in the X-Y plane, but can be linear in the Y-Z plane such that the insole 220 supports the natural gait of the wearer, the dampener 232 is unlikely to buckle medially or laterally, etc.

Figure 9:
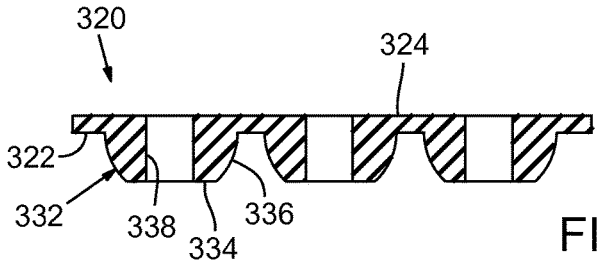
FIG. 9 is a section view of additional embodiments of the insole.

Referring now to FIG. 9, additional embodiments of the insole 320 are illustrated. Components that are similar to those of the embodiments of FIGS. 1-4 are indicated with corresponding reference numbers increased by 300.

As shown, the dampeners 332 can be shaped generally as truncated hemispheres. More specifically, the inferior surface 334 can be annular and substantially parallel to the base 322, and the sidewall 336 can curve convexly and superiorly therefrom towards the base 322.

Figure 10:
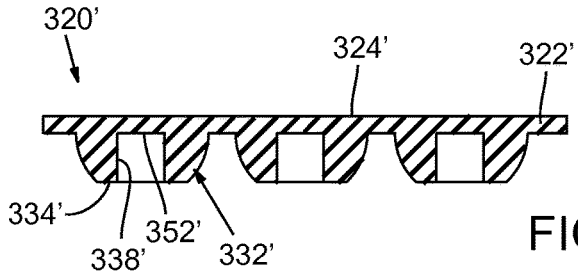
FIG. 10 is a section view of additional embodiments of the insole.

Also, the openings 338 can be through holes that extend through the dampeners 332 and the base 322. This is in contrast to the embodiments of the insole 320' illustrated in FIG. 10, wherein the openings 338' are cup-shaped recesses that extend through the inferior surface 334' of the dampener 332', and the openings 338' terminate at an interior surface 352'. The interior surface 352' is disposed between the inferior surface 334' and the superior surface 324' of the base 322'.

Figure 11:
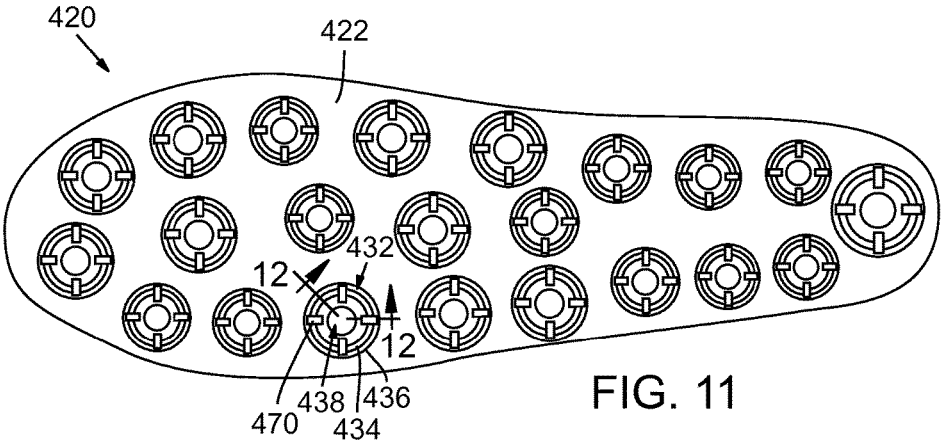
FIG. 11 is a bottom view of additional embodiments of the insole.
Figure 12:
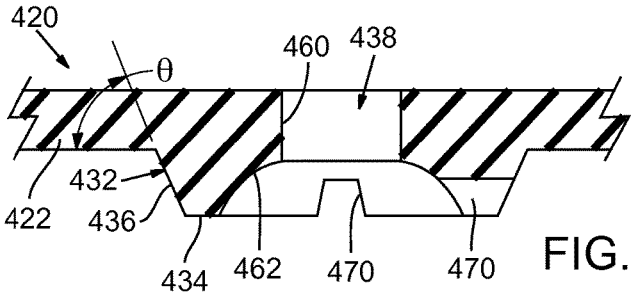
FIG. 12 is a section view of the insole taken along the line 12-12 of FIG. 11.
Figure 13:
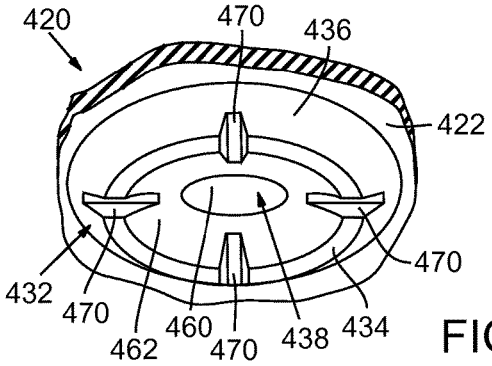
FIG. 13 is a bottom, isometric view of a dampener of the insole of FIG. 11.

Referring now to FIGS. 11-13, additional embodiments of the insole 420 are illustrated. Components that correspond to those of the embodiments of FIGS. 1-4 are indicated with corresponding reference numbers increased by 400.

As shown, the exterior of the dampeners 432 can be frusto-conic in shape. More specifically, the inferior surface 434 of the dampeners 432 can be parallel to the base 422, and the sidewall 436 can be disposed at an acute angle θ relative to the base 422 and inferior surface 434.

Furthermore, the opening 438 can have a superior portion 460 and an inferior portion 462. The superior portion 460 can have a substantially constant diameter or width along the inferior-superior direction. The inferior portion 462 can be concave and can have a generally female-hemispherical shape such that the width gradually reduces in the superior direction.

Moreover, the dampener 432 can include one or more channels 470 that extend transversely through the sidewall 436 and superiorly through the inferior surface 434. The channels 470 can extend transversely along a substantially straight longitudinal axis. The channels 470 can be in fluid communication with the opening 438 and can radiate therefrom. In the embodiments illustrated, there are four channels 470 that are equally spaced apart from each other by approximately 90 degrees. However, it will be appreciated that there can be any suitable number of channels 470, and the channels 470 can be arranged in any suitable fashion. It will be appreciated that the channels 470 can advantageously increase airflow through the insole 420.

In summary, the insoles 20, 120, 220, 320, 320', 420 can provide improved cushioning for the wearer. Also, the insoles 20, 120, 220, 320, 320', 420 can allow for substantial airflow therethrough such that the insole 20, 120, 220, 320, 320', 420 to reduce build-up of perspiration, etc.

Individual elements or features of a particular aspect of the insoles are generally not limited to that particular aspect, but, where applicable, are interchangeable and can be used in a selected aspect, even if not specifically shown or described. The same also may be varied in many ways. Such variations are not to be regarded as a departure from the present disclosure, and ail such modifications are intended to be included within the scope of the present disclosure.

I claim:

1. An insole for an article of footwear having a ground-engaging surface, the insole comprising:

a base including a first surface defining a first portion of a foot-contacting surface and a second surface disposed on an opposite side of the base than the first surface;

a plurality of dampeners each including a cylindrical sidewall extending from the second surface of the base in a direction towards the ground-engaging surface of the article of footwear and terminating at a distal surface, the cylindrical sidewall defining a cylindrical opening that extends continuously from the first surface of the base to the distal surface of the dampener; and a plurality of bumps extending from the first surface of the base in an opposite direction from the plurality of dampeners and defining a second portion of the foot-contacting surface, each of the plurality of the bumps disposed between adjacent dampeners.

2. The insole of claim 1, wherein a diameter of the cylindrical opening is constant from the distal surface to the first surface.

3. The insole of claim 1, wherein the distal surface of the dampeners is annular.

4. The insole of claim 3, wherein the distal surface of the dampeners is substantially planar.

5. The insole of claim 4, wherein the distal surface of the dampeners is substantially parallel to the base.

6. The insole of claim 1, wherein the distal surface of the dampeners is substantially planar.

7. The insole of claim 1, wherein the dampeners and the base are part of the same monolithic structure.

8. The insole of claim 1, further comprising a peripheral edge extending from the first surface in the direction away from the second surface along a heel region of the insole.

9. The insole of claim 1, wherein each of the plurality of bumps is hemispherical.

10. The insole of claim 1, wherein a thickness of the cylindrical sidewall is constant from the distal surface to the second surface of the base.

11. An insole for an article of footwear having a ground-engaging surface, the insole comprising:

a base including a first surface defining a first portion of a foot-contacting surface and a second surface disposed on an opposite side of the base than the first surface;

a plurality of dampeners each including a sidewall extending from the second surface of the base in a direction towards the ground-engaging surface of the article of footwear and terminating at a distal surface, the sidewall extending perpendicular to the second surface and defining an opening that extends continuously from the first surface of the base to the distal surface of the dampener; and a plurality of bumps extending from the first surface of the base in an opposite direction from the plurality of dampeners and defining a second portion of the foot-contacting surface, each of the plurality of the bumps disposed between adjacent dampeners.

12. The insole of claim 11, wherein a width of the opening is constant from the distal surface to the first surface.

13. The insole of claim 11, wherein the distal surface of the dampeners is annular.

14. The insole of claim 13, wherein the distal surface of the dampeners is substantially planar.

15. The insole of claim 14, wherein the distal surface of the dampeners is substantially parallel to the base.

16. The insole of claim 11, wherein the distal surface of the dampeners is substantially planar.

17. The insole of claim 11, wherein the dampeners and the base are part of the same monolithic structure.

18. The insole of claim 11, further comprising a peripheral edge extending from the first surface in the direction away from the second surface along a heel region of the insole.

19. The insole of claim 11, wherein each of the plurality of bumps is hemispherical.

20. The insole of claim 11, wherein a thickness of the sidewall is constant from the distal surface to the second surface of the base.

* * * * *